US006922191B2

(12) United States Patent
Watanabe

(10) Patent No.: US 6,922,191 B2
(45) Date of Patent: Jul. 26, 2005

(54) PLASMA DISPLAY PANEL DRIVE APPARATUS AND DRIVE METHOD

(75) Inventor: Takuya Watanabe, Tokyo (JP)

(73) Assignee: Pioneer Plasma Display Corporation, Kagoshima Prefecture (JP)

( * ) Notice: Subject to any disclaimer, the term of this patent is extended or adjusted under 35 U.S.C. 154(b) by 257 days.

(21) Appl. No.: 09/739,789

(22) Filed: Dec. 20, 2000

(65) Prior Publication Data

US 2001/0005188 A1 Jun. 28, 2001

(30) Foreign Application Priority Data

Dec. 24, 1999 (JP) ..... 11-367395

(51) Int. Cl.[7] ..... G09G 5/00; G09G 3/28
(52) U.S. Cl. ..... 345/211; 345/63; 315/169.4
(58) Field of Search ..... 345/60–72, 210–212; 315/169.1–169.4

(56) References Cited

U.S. PATENT DOCUMENTS

| | | | | |
|---|---|---|---|---|
| 5,786,794 A | * | 7/1998 | Kishi et al. | 345/60 |
| 5,943,030 A | * | 8/1999 | Minamibayashi | 345/60 |
| 6,011,355 A | * | 1/2000 | Nagai | 315/169.3 |
| 6,111,556 A | * | 8/2000 | Moon | 345/60 |
| 6,323,829 B1 | * | 11/2001 | Hosoi et al. | 345/60 |
| 6,452,590 B1 | * | 9/2002 | Awamoto et al. | 345/211 |
| 6,466,186 B1 | * | 10/2002 | Shimizu et al. | 345/60 |

FOREIGN PATENT DOCUMENTS

| | | |
|---|---|---|
| JP | 08-314405 | 11/1996 |
| JP | 10-105113 | 4/1998 |
| JP | 2776298 | 5/1998 |
| JP | 10-319902 | 12/1998 |
| JP | 2874671 | 1/1999 |
| JP | 11-282416 | 10/1999 |
| JP | 11-316572 | 11/1999 |
| JP | 2001-075528 | 3/2001 |

OTHER PUBLICATIONS

Japanese Office Action dated Feb. 10, 2004 with a partial English translation.

* cited by examiner

*Primary Examiner*—Amr A. Awad
(74) *Attorney, Agent, or Firm*—Morgan, Lewis & Bockius LLP

(57) ABSTRACT

A drive apparatus for a plasma display panel useing a charge recovery circuit 12 that re-uses a recovered electrical charge, the drive apparatus comprising: a brightness detection means 16, 17 for detecting a brightness so as to obtain screen brightness information; and a charge recovery timing control means 4 for controlling a charge recovery period T from a time at which a charge recovery operation of the charge recovery circuit 12 starts to a time of fixing to a sustaining potential or a ground potential, wherein the charge recovery timing control means 4 controls the charge recovery period of the charge recovery circuit 4 in response to the brightness information obtained by the brightness detection means 16, 17.

14 Claims, 5 Drawing Sheets

PLASMA DISPLAY PANEL DRIVE APPARATUS AND DRIVE METHOD

BACKGROUND OF THE INVENTION

1. Field of the Invention

The present invention relates to a plasma display panel drive apparatus and to a drive method therefor, and more particularly to a plasma display panel drive apparatus with improved display quality and a drive method therefor.

2. Related Art

In a plasma display panel, a charge recovery circuit is provided to improve the power efficiency.

A basic approach to charge recovery by the charge recovery circuit is that which focuses on the functioning of an AC-type plasma display as a capacitor after the completion of discharge, wherein the electrical charge accumulated on the panel is extracted using an LC resonant circuit, this being used when discharging again, thereby reducing the reactive power and improving the power efficiency.

However, if the time constant of the LC resonant circuit is made large in order to achieve a sufficient recovery efficiency, the action of electrical charge recovery causes a loss of sharpness in the sustaining pulse applied to the scanning and common electrodes, so that there is a tendency for discharge to start before the drive voltage has risen completely. If discharge occurs midway during electrical charge recovery, the discharge current is supplied from the LC resonant circuit rather than the power supply line, the energy stored in the inductance being the only source of supply, so that the power supply capacity is small, making the voltage drop due to the discharge current large. Because of this voltage drop, the discharge is weakened, resulting in a reduced intensity.

A strong discharge can be caused in order to increase the intensity. It is also effective to make the rising edge and the falling edge of the drive waveform sharp, and this can be achieved by advancing the timing after the charge recovery at which the electrode potential is fixed at the power supply potential. If this is done, however, there is not only a decrease in the charge recovery efficiency, but there is an increase in the variation in intensity (hereinafter referred to as the load variation) caused by a variation in the display load amount, which is established by the number of light-emitting pixels in one line.

However, in order to reduce the variation in the intensity and obtain smooth gray-scale characteristics, it is preferable to retard the timing of fixing the electrode potential to the power supply potential, and it is difficult to achieve these conflicting conditions.

Accordingly, in order to improve on the above-noted drawbacks in the prior art, it is an object of the present invention to provide a novel plasma display panel drive apparatus and drive method therefor, wherein when the overall screen display intensity is high and an image is displayed that requires smooth gray-scale rendering, the clamp timing of the sustaining pulse is controlled so as to give priority to gray-scale characteristics, and when the overall screen display intensity is low and a high peak intensity is required, the clamp timing of the sustaining pulse is performed so as to achieve a high peak intensity, thereby improving the display quality.

SUMMARY OF THE INVENTION

To achieve the above-noted object, the present invention has the following basic technical constitution.

Specifically, a first aspect of the present invention is a drive apparatus for a plasma display panel comprising a charge recovery circuit that re-uses a recovered electrical charge, the drive apparatus comprising: a brightness detection means for detecting a brightness so as to obtain screen brightness information; and a charge recovery timing control means for controlling a charge recovery period from a time at which a charge recovery operation of the charge recovery circuit starts to a time of fixing to a sustaining potential or a ground potential, wherein the charge recovery timing control means controls the charge recovery period of the charge recovery circuit in response to the brightness information obtained by the brightness detection means.

In a second aspect of the present invention, the brightness detection means comprising: an image signal accumulator for accumulating an brightness of each pixel of the plasma display panel for each frame or for each field of an image signal; and an accumulated value comparator for determining whether an accumulated value detected by the image signal accumulator is larger or smaller than a prescribed value.

In a third aspect of the present invention, the image signal accumulator accumulates an brightness of all pixels in an effective display area of the plasma display panel.

In a fourth aspect of the present invention, the image signal accumulator accumulates only a brightness of pre-established pixels within an effective display area of the plasma display panel.

In a fifth aspect of the present invention, the charge recovery timing control means controls so that, when the accumulated value obtained by the image signal accumulator is lower than a prescribed value the charge recovery period is made relatively short, and further so that, when the accumulated value obtained by the image signal accumulator is higher than the prescribed value the charge recovery period is made relatively long.

In a sixth aspect of the present invention, the charge recovery timing control means controls to change the charge recovery period for only a sub-field that has a relatively large brightness weight, and to leave the charge recovery period for a sub-field having a relatively small brightness weight unchanged.

In a seventh aspect, the apparatus of the present invention further comprising a pixel counting means for counting a number of pixels of a brightness exceeding a pre-established reference brightness, wherein in a case in which a value counted by the pixel counting means is below a pre-established value, the charge recovery timing control means control so as to make the charge recovery period relatively long.

In a eighth aspect of the present invention, the image signal accumulator accumulates an brightness of each pixel and then determines the average brightness.

In a ninth aspect of the present invention, the brightness detection means comprises a power consumption detection means for measuring a power consumption of the plasma display panel.

A tenth aspect of the present invention is a method for driving a plasma display panel comprising a charge recovery circuit for refusing a recovered electrical charge, the method comprising: a first step of accumulating a brightness of each pixel of the plasma display panel for each frame or for each field of an image signal; a second step of comparing the value accumulated in the first step so as to determine whether the value is larger or smaller than a prescribed value, a third step of changing a charge recovery period from a time at which a charge recovery operation of the charge recovery circuit starts to a time of fixing to a sustaining potential or a ground potential, in response to the comparison results obtained in the second step.

In a drive circuit for an AC-type plasma display panel according to the present invention, the operational timing of the charge recovery that is performed mainly for the purpose of improving power efficiency is variably controlled in response to an accumulated value of the intensity of the input image signal for each frame or each field, so that when the input signal accumulated value is low control is performed to make the charge recovery period from the starting point of the charge recovery operation to the time of fixing to the sustaining potential or the ground potential short, resulting in an increase in the peak brightness for a small-area display, and further so that when the input signal accumulated value is high, control is performed to make charge recovery period from the starting point of the charge recovery operation to the time of fixing at the sustaining potential or the ground potential long, the overall result being an increase in the peak intensity in a dark image, without a sacrificing of gray-scale characteristics for a bright image.

FIG. 4 of the accompanying drawings is a graph showing the peak intensity variation, with the charge recovery period from the starting point of the charge recovery operation to the time of fixing to the sustaining potential or the ground potential taken as a parameter, for the case in which the overall screen is dark, with just a specific small surface area thereof having a high brightness.

As can be seen from this drawing, if the charge recovery period is made short, if only a small surface area of the display has a high intensity it is possible to make the peak brightness high. However, because the electrode potential is clamped before the charge recovery is completed, in addition to a decrease in the power efficiency, there is a large variation in brightness dependent on the load amount.

If the charge recovery period is made long, because sufficient charge recovery is achieved, the power efficiency is good and there is not a great variation in intensity related to the amount of load, although the peak intensity is low when compared to the case of making the charge recovery period short.

The present invention was made in consideration of the above-noted effect and, for the case of a relatively bright display screen that has a high average image intensity level, because there is a need for smooth gray-scale characteristics, the present invention makes the charge recovery period long, but in the case in which the average image intensity is low, and the image is relatively dark, the present invention makes the intensity of a relatively small surface area requiring the peak intensity high, thereby seeking to achieve both good gray-scale characteristics and peak intensity characteristics.

DETAILED DESCRIPTION OF THE PREFERRED EMBODIMENTS

Preferred embodiments of a plasma display panel drive apparatus and drive method according to the present invention are described in detail below, with references made to relevant accompanying drawings.

Figure 1:
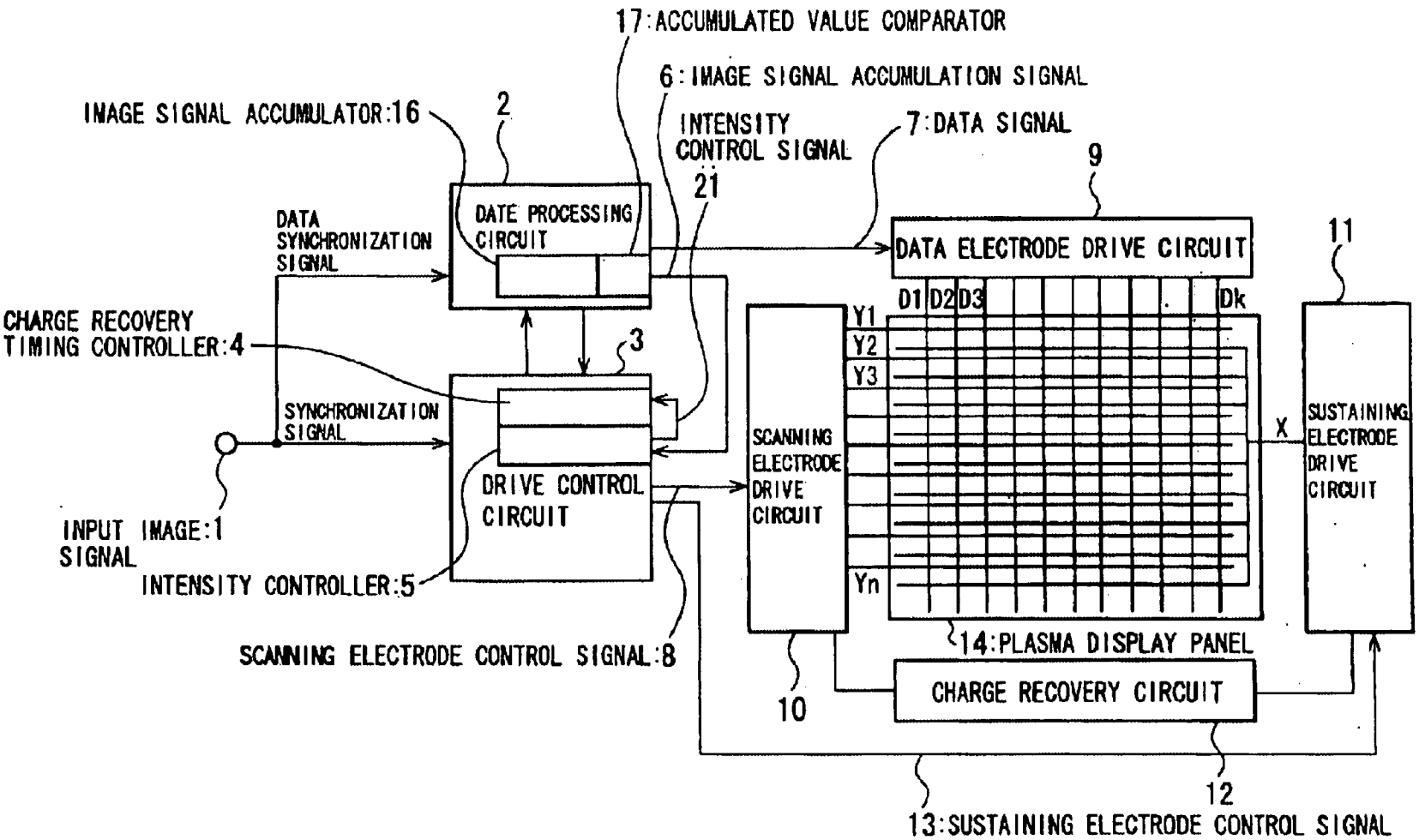
FIG. 1 is a block diagram of a drive apparatus for a plasma display panel according to the present invention.

FIG. 1 shows a first embodiment of a plasma display panel drive apparatus according to the present invention.

The plasma display panel drive apparatus shown in FIG. 1 comprises a plasma display panel 14, the electrical charge of which is recovered by the charge recovery circuit 12 and re-used, this drive apparatus has an image signal accumulator 16, for accumulating the intensity of each pixel of a plasma display panel for each frame or for each field of an image signal, an accumulated value comparator 17 for performing a comparison to determine whether an accumulated value detected by the image signal accumulator 16 is larger or smaller than a prescribed value, and a charge recovery timing controller 4 for the purpose of varying the charge recovery period T (refer to FIG. 3) from the time at which the charge recovery operation of the charge recovery circuit starts to the time of fixing at a sustaining potential or the ground potential, based on the comparison results of the accumulated value comparator 17, wherein the charge recovery timing of the charge recovery circuit 12 is controlled in accordance with the screen intensity detected by the image signal accumulator 16.

It is a feature of this embodiment that the image signal accumulator 16 accumulates the intensity of all pixels of the effective display area of the plasma display panel 14.

It will be understood that the configuration can alternately be one in which the image signal accumulator 16 partially samples the pixels to be accumulated, so that the intensity of only pre-established pixels of the effective display area of the plasma display panel is accumulated.

When the accumulated value obtained by the image signal accumulator 16 is lower than the prescribed value, the charge recovery timing controller 4 performs control so that the charge recovery period T (FIG. 3) is made relatively short, and when the accumulated value obtained by the image signal accumulator 6 is higher than the prescribed value, the charge recovery timing controller 4 performs control so that the charge recovery period T is made relatively long.

It is alternately possible to use a configuration in which the image signal accumulator 16, after accumulating the intensity of each pixel, determines an average intensity.

Another alternate configuration of the present invention is one in which the charge recovery timing controller 4 performs controlling of the charge recovery period T for only a sub-field having an intensity weight that is relatively large, and does not control the charge recovery period for a sub-field having a relatively small intensity weight.

The first embodiment of the present invention is described in further detail below.

Referring to FIG. 1, the first embodiment of the present invention is formed by a data processing circuit 2, a drive control circuit 3, a data electrode drive circuit 9, scanning electrode drive circuit 10, a sustaining electrode drive circuit 11, a charge recovery circuit 12, an a plasma display panel 14.

The data processing circuit 2 has an image signal accumulator 16 and an accumulated value comparator 17, The image signal accumulator 16 accumulates the intensities of all R, G, and B pixels for each frame or for each field of a TV signal so as to obtain an accumulated intensity value, and detects an average intensity of the plasma display panel, and the accumulated value comparator 17 performs a comparison to determine whether the accumulated intensity value or average intensity value detected by the image signal accumulator 16 is larger or smaller than a prescribed value.

The drive control circuit 3 has a charge recovery timing controller 4 and an intensity controller 5.

The image signal accumulation signal 6, which is the output signal from the image signal accumulator 16, indicates the average intensity of the accumulated value, and includes a value indicating the average intensity level of the screen. At the intensity controller 5, in order to obtain a maximum peak intensity within the allowable power consumption, the value of the image signal accumulation signal 6 is used to control the number or sustaining pulses generated at the drive controller 3.

Additionally, an intensity control signal 21 is output from the intensity controller 5, this intensity control signal 21 being sent to the charge recovery timing controller 4, so that the operational timing of charge recovery is optimized, in synchronization with the intensity controller 5.

Figure 2:
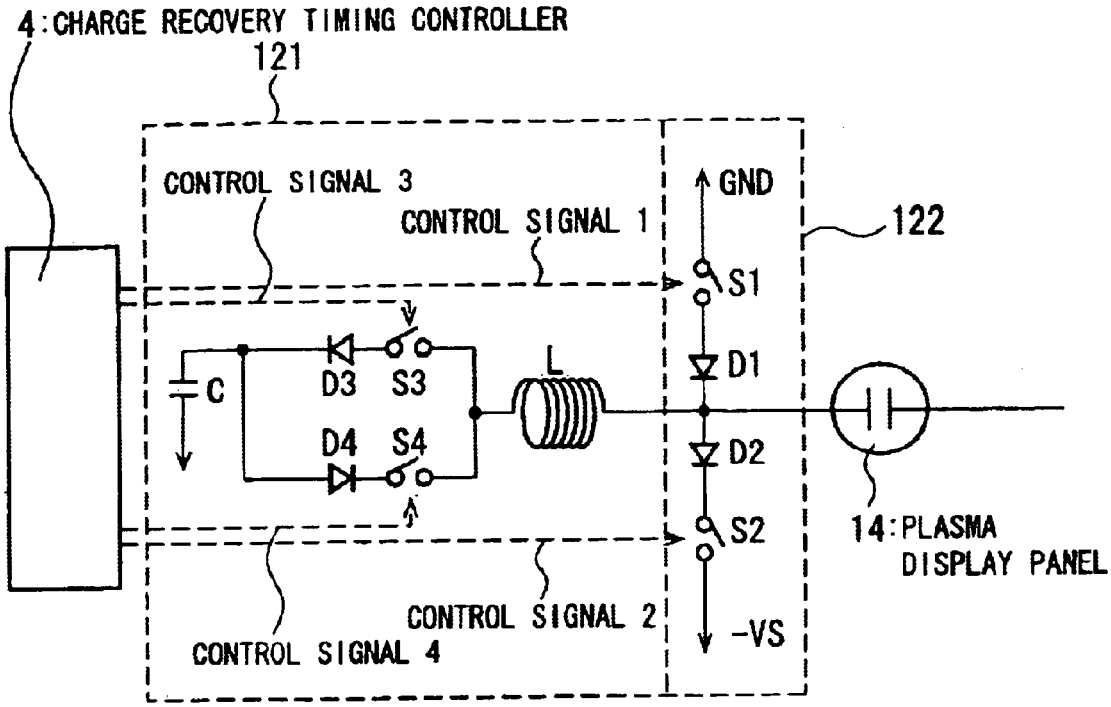
FIG. 2 is a circuit diagram showing a first embodiment of a charge recovery circuit according to the present invention.

FIG. 2 is a circuit showing a charge recovery circuit 12 according to the present invention, in which the reference numeral 12 denotes a charge recovery circuit formed by a coil L and a capacitor C, which recovers a charge by control of the switches S3 and S4, the recovered charge being returnable to the plasma display panel 14. The reference numeral 122 denotes a voltage clamper, which by controlling switches S1 and S2 clamps a sustaining pulse to the ground level or the a prescribed voltage −VS, and which by controlling the on/off timing of the switches S1 and S2, performs control so as to make the charge recovery period T long or short.

Figure 3:
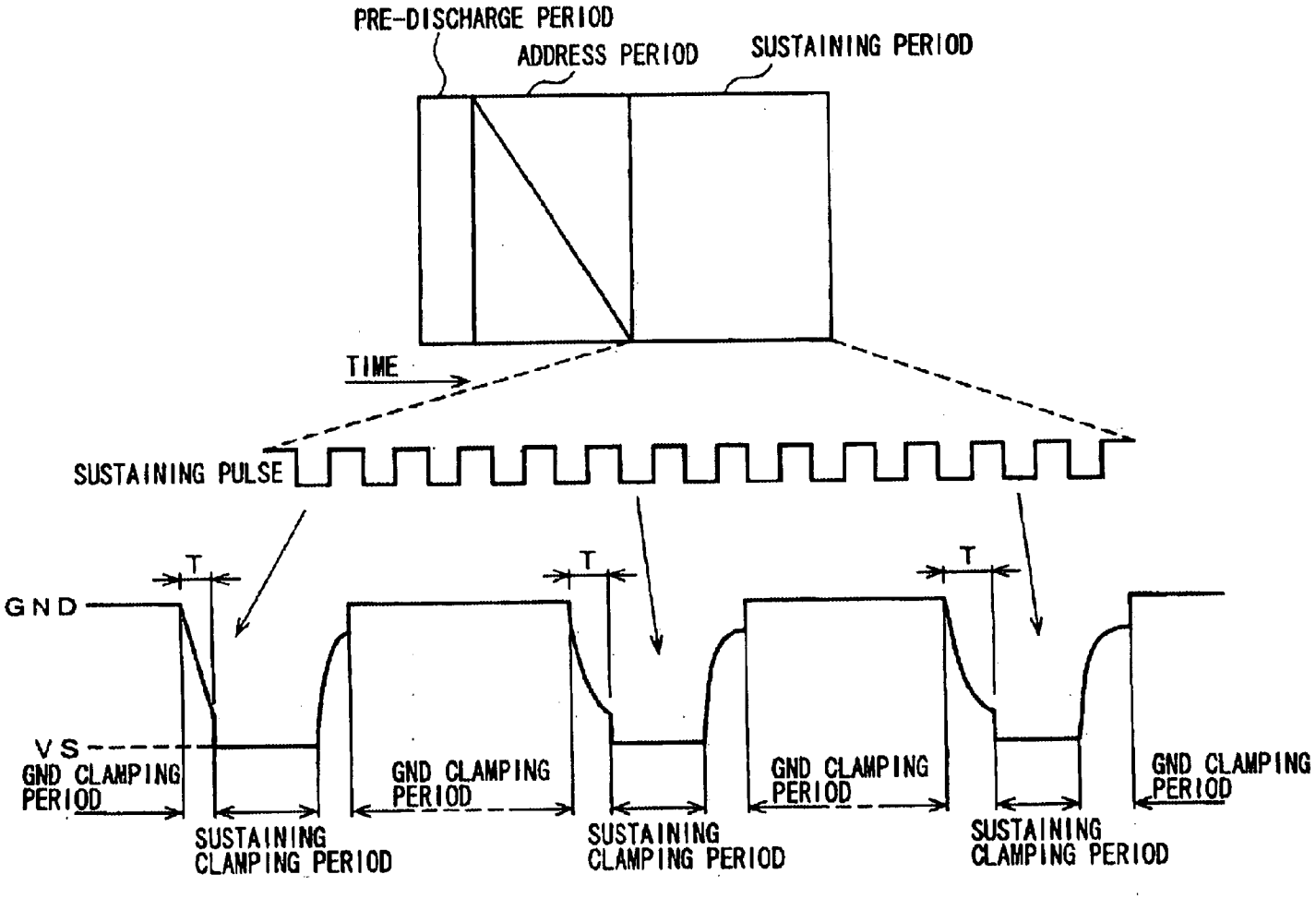
FIG. 3 is a drawing showing a sustaining pulse.
Figure 4:
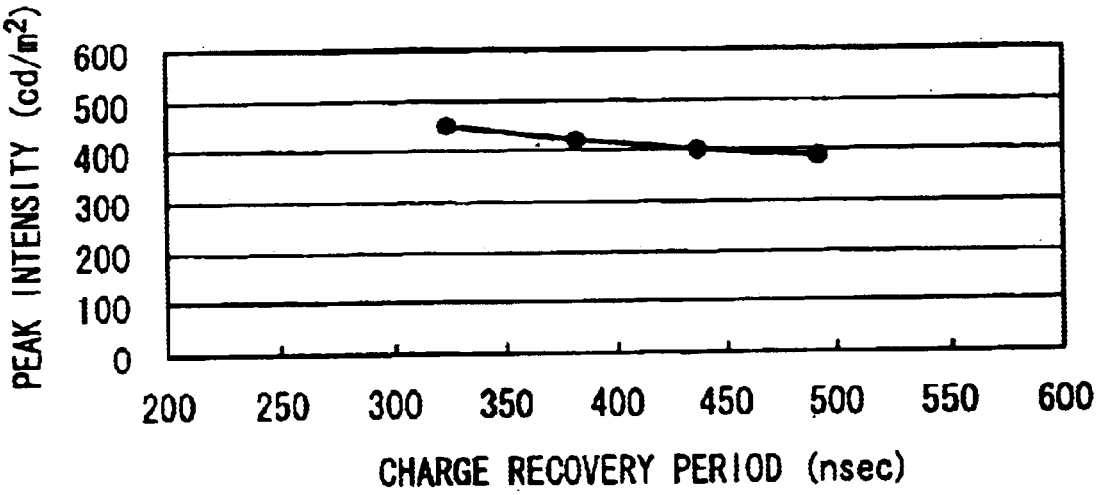
FIG. 4 is a graph showing the relationship of the peak intensity to the potential fixing starting timing.

FIG. 3 is a drawing showing the case in which it is possible to make the charge recovery period T long or short, the sustaining pulse shown at the left being an example of making the charge recovery period T short, and the the sustaining pulse shown at the right being an example of making the charge recovery period T long, In this embodiment, although the charge recovery timing controller 4 is configured so as to perform simple control to two conditions, one for the case in which the charge recovery period T is made short, and one for the case in which the charge recovery period T is made long, it will be understood that it is further possible to employ a configuration in which finer control of a number of steps of charge recovery period T is performed.

The operation of a drive circuit for a plasma display panel configured as described above is as follows.

An input image signal 1 is input to the data processing circuit 2. Simultaneously with this, a vertical synchronization signal of the input signal is input to the drive controller 3, and used as a reference signal for controlling the drive sequence and the input image signal synchronization.

At the data processing circuit 2, signal processing and re-arrangement of the input image signal 1 are performed, the results being sent to the data electrode drive circuit 9, and the intensity of the input image signal for each frame or each field is accumulated by the image signal accumulator 16, normalization thereof being performed, and the result being sent to the drive control circuit 3 as the image signal accumulation signal 6.

At the intensity controller 5 provided at the drive controller 3, if, based on the image signal accumulation signal 6, the accumulated intensity of the image signal accumulation signal 6 is high, the number of sustaining light-emission pulses is reduced, thereby suppressing the screen intensity.

Additionally, an intensity control signal 21 for the purpose of controlling the charge recovery period T is sent from the intensity controller 5 to the charge recovery timing controller 4, the charge recovery period T being changed in synchronization with control of the number of sustaining pulses by means of the intensity controller 5. In the case in which the image signal accumulation signal 6 indicates a reduction in the screen intensity, the intensity control signal 21 makes the charge recovery period T of the sustaining pulse long, and control is performed so as to reduce a worsening of the gray-scale characteristics by load variations, and in the case in which the image signal accumulation signal 6 indicates an increase in the screen intensity, the intensity control signal 21 makes the charge recovery period T short, so as to increase the peak intensity.

In an alternate configuration, the image signal accumulation signal 6 is input directly to the charge recovery timing controller 4, without passing through the intensity controller 5.

It is alternately possible to provide a power consumption detection means for measuring the power consumption of the plasma display panel, and to control the charge recovery period T based on the detection results from this detection means.

Figure 5:
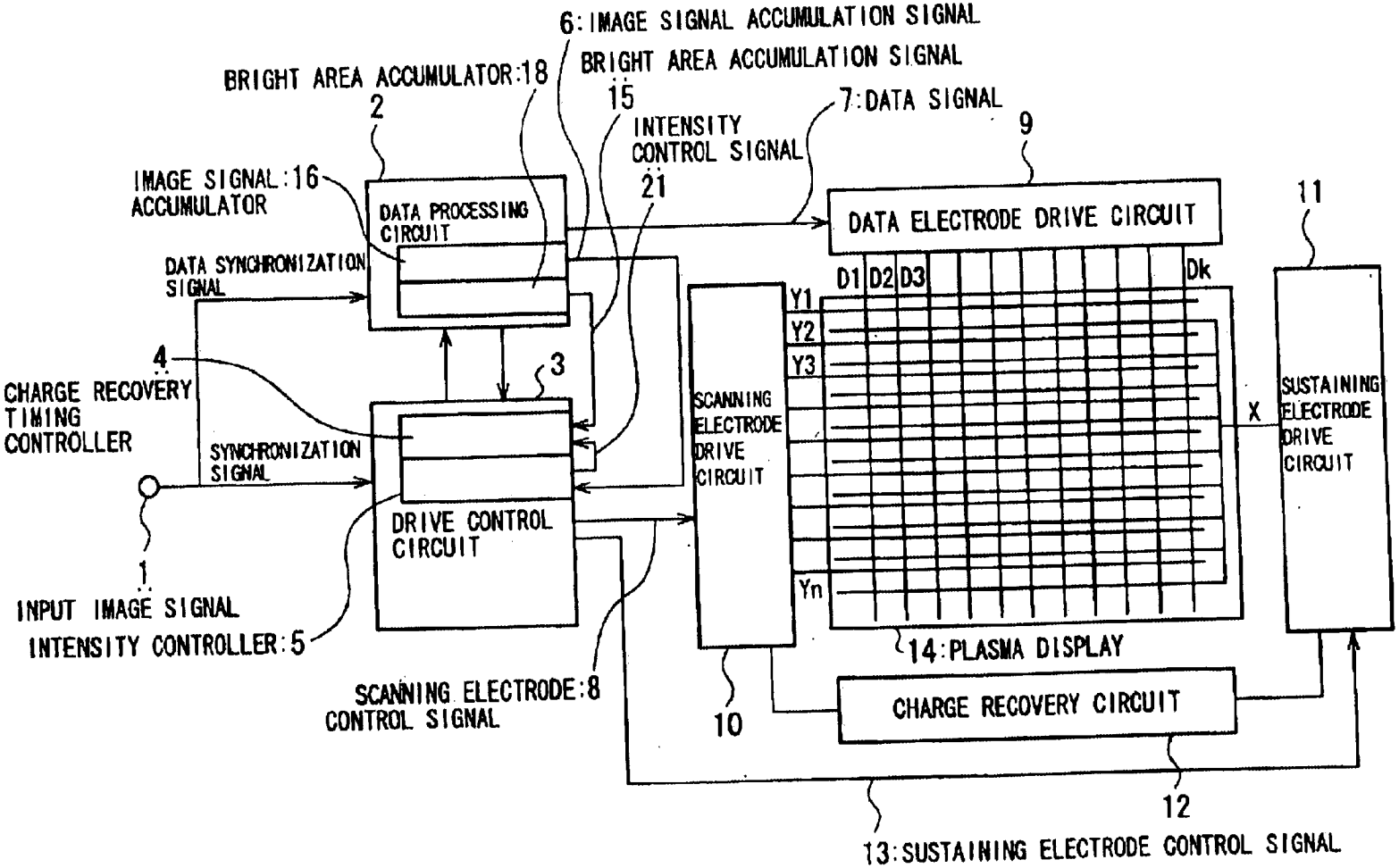
FIG. 5 is a block diagram showing a second embodiment of the present invention.

FIG. 5 is a block diagram showing a second embodiment of the present invention.

In the second embodiment, even if image signal accumulation signal indicates low value, for an image having a small difference in intensity in the intensity distribution within the screen, control is performed so as to give priority to achieving gray-scale characteristics, as opposed to making a display giving priority to achieving peak intensity. It is therefore possible with the second embodiment to achieve a display with superior gray-scale characteristics, even in the case of a overall dark display screen.

In this configuration, first intensity data of the RGB cells for each pixel is compared to determine if it is higher or lower than a reference value, the number of pixels for which the intensity is higher than the above-noted value is then counted for each frame or each field, after which, in the case in which if there is a large number of pixels having an intensity higher than the above-noted reference value, control is performed to shorten the charge recovery period T so as to give priority to intensity. However, if the number of pixels having a higher intensity than the reference value is small, control is performed to lengthen the charge recovery period T, so as to give priority to gray-scale characteristics.

Thus, in the second embodiment, a bright area accumulator 18, which is a counter for counting the number of pixels having an intensity higher than a pre-established reference value, is provided, and in the case in which the value counted by the bright area accumulator 18 is below a pre-established set value, the charge recovery timing controller 4 performs control so as to make the charge recovery period relatively long. For this reason, the bright area accumulation signal 15, which is the output signal from the bright area accumulator 18, is directly input to the charge recovery timing controller 4.

By adopting the above-described constitution, a plasma display panel drive apparatus according to the present invention as described above maintain the same gray-scale characteristics as in the past for a screen having a high average intensity, and enable the high peak intensity for a screen having a low average intensity.

What is claimed is:

1. A drive apparatus for a plasma display panel comprising a charge recovery circuit that re-uses a recovered electrical charge, said drive apparatus comprising:

a brightness detection circuit for detecting a brightness so as to obtain screen brightness information; and a charge recovery timing control circuit for controlling a charge recovery period from a time at which a charge recovery operation of said charge recovery circuit starts to a time of fixing to a sustaining potential or a ground potential, wherein said charge recovery timing control circuit controls said charge recovery period of said charge recovery circuit in response to said brightness information obtained by said brightness detection circuit, wherein said brightness detection circuit comprises:

an image signal accumulator for accumulating a brightness of each pixel of said plasma display panel for each frame or for each field of an image signal; and an accumulated value comparator for determining whether an accumulated value detected by said image signal accumulator is larger or smaller than a prescribed value.

2. A drive apparatus for a plasma display panel according to claim 1, wherein said image signal accumulator accumulates a brightness of all pixels in an effective display area of said plasma display panel.

3. A plasma display panel drive apparatus according to claim 1, wherein said image signal accumulator accumulates only a brightness of pre-established pixels within an effective display area of said plasma display panel.

4. A drive apparatus for a plasma display panel according to claim 1, wherein said charge recovery timing control circuit controls so that, when said accumulated value obtained by said image signal accumulator is made lower than a prescribed value said charge recovery period is made shorter, and further so that, when said accumulated value obtained by said image signal accumulator is made higher than said prescribed values, said charge recovery period is made longer.

5. A drive apparatus for a plasma display panel comprising a charge recovery circuit that re-uses a recovered electrical charge, said drive apparatus comprising:

a brightness detection circuit for detecting a brightness so as to obtain screen brightness information; and a charge recovery timing control circuit for controlling a charge recovery period from a time at which a charge recovery operation of said charge recovery circuit starts to a time of fixing to a sustaining potential or a ground potential, wherein said charge recovery timing control circuit controls said charge recovery period of said charge recovery circuit in response to said brightness information obtained by said brightness detection circuit, wherein said charge recovery timing control circuit controls to increases said charge recovery period for only a sub-field that has a brightness larger than a first brightness amount, and to leave said charge recovery period unchanged for a sub-field having a brightness smaller than a second brightness amount.

6. A drive apparatus for a plasma display panel comprising a charge recovery circuit that re-uses a recovered electrical charge, said drive apparatus comprising:

a brightness detection circuit for detecting a brightness so as to obtain screen brightness information;

a charge recovery timing control circuit for controlling a charge recovery period from a time at which a charge recovery operation of said charge recovery circuit starts to a time of fixing to a sustaining potential or a ground potential, wherein said charge recovery timing control circuit controls said charge recovery period of said charge recovery circuit in response to said brightness information obtained by said brightness detection circuit; and a pixel counting circuit for counting a number of pixels of a brightness exceeding a pre-established reference brightness, wherein in a case in which a value counted by said pixel counting circuit is decreases below a pre-established value, said charge recovery timing control circuit controls so as to make said charge recovery period longer.

7. A drive apparatus for a plasma display panel according to claim 1, wherein said image signal accumulator accumulates a brightness of each pixel and then determines the average brightness.

8. A drive apparatus for a plasma display panel comprising a charge recovery circuit that re-uses a recovered electrical charge, said drive apparatus comprising:

a brightness detector for detecting a brightness so as to obtain screen brightness information; and a charge recovery timing controller for controlling a charge recovery period in response to said brightness information obtained by said brightness detector, wherein said brightness detector further comprises:

an image signal accumulator for accumulating a brightness of each pixel of said plasma display panel for each frame or for each field of an image signal, and an accumulated value comparator for determining whether an accumulated value detected by said image signal accumulator is larger or smaller than a prescribed value.

9. The drive apparatus for a plasma display panel according to claim 8, wherein said image signal accumulator accumulates the intensity of each pixel of said plasma display panel for each frame or for each field of an image signal.

10. The drive apparatus for a plasma display panel according to claim 8, wherein said image signal accumulator accumulates the intensity of all pixels in an effective display area of said plasma display panel.

11. A method for controlling a plasma display panel comprising a charge recovery circuit that re-uses a recovered electrical charge, said drive apparatus comprising:

a brightness detection circuit for detecting a brightness so as to obtain screen brightness information; and a charge recovery timing control circuit for controlling a charge recovery period in response to said brightness information obtained by said brightness detection circuit, said method comprising:

accumulating a brightness of each pixel of said plasma display panel for each frame or for each field of an image signal with an image signal accumulator; and determining whether an accumulated value detected by said image signal accumulator is larger or smaller than a prescribed value with an accumulated value comparator.

12. The method for controlling a plasma display panel according to claim 11, wherein said charge recovery period is a period from a time at which a charge recovery operation of said charge recovery circuit starts to a time of fixing to a sustaining potential or a ground potential.

13. A method for controlling a plasma display panel comprising a charge recovery circuit that re-uses a recovered electrical charge, said drive apparatus comprising:

a brightness detection circuit for detecting a brightness so as to obtain screen brightness information; and a charge recovery timing control circuit for controlling a charge recovery period in response to said brightness information obtained by said brightness detection circuit; said method comprising:

controlling the drive apparatus to increase said charge recovery period for only a sub-field that has a brightness larger than a first brightness amount; and leaving said charge recovery period unchanged for a sub-field having a brightness less than a second brightness amount.

14. A method for controlling a plasma display panel comprising a charge recovery circuit that re-uses a recovered electrical charge, said drive apparatus comprising:

a brightness detection circuit for detecting a brightness so as to obtain screen brightness information; and a charge recovery timing control circuit for controlling a charge recovery period in response to said brightness information obtained by said brightness detection circuit, said method comprising:

counting a number of pixels of a brightness exceeding a pre-established reference brightness with a pixel counting circuit; and controlling so as to make said charge recovery period longer with said charge recovery timing control circuit, in a case in which a value counted by said pixel counting circuit decreases below a pre-established value.

* * * * *